United States Patent [19]

Wood et al.

[11] 4,010,847

[45] Mar. 8, 1977

[54] ARTICLE CARRIER

[75] Inventors: Prentice J. Wood, Jonesboro; James T. Stout, Acworth, both of Ga.

[73] Assignee: The Mead Corporation, Dayton, Ohio

[22] Filed: Dec. 19, 1975

[21] Appl. No.: 642,370

[52] U.S. Cl. ..... 206/187; 206/190

[51] Int. Cl.[2] ..... B65D 5/48; B65D 85/30

[58] Field of Search ..... 206/170–191, 206/193

[56] References Cited

UNITED STATES PATENTS

| | | | |
|---|---|---|---|
| 2,846,114 | 8/1958 | Ringler | 206/190 X |
| 3,093,265 | 6/1963 | Arneson | 206/190 X |
| 3,400,856 | 9/1968 | Arneson | 206/188 X |
| 3,567,069 | 3/1971 | Harrelson | 206/188 X |

*Primary Examiner*—William Price
*Assistant Examiner*—Stephen Marcus
*Attorney, Agent, or Firm*—Walter M. Rodgers; Walter A. Rodgers

[57] ABSTRACT

An article carrier formed from a unitary blank comprising a bottom wall, side walls foldably joined to the side edges of the bottom wall, end wall panels foldably joined to the end edges of the side walls and extending inwardly therefrom, medial partition structure at each end of the carrier comprising a pair of medial panels foldably joined respectively to the end wall panels along the edges thereof remote from the side walls and extending medially inward of the carrier, a multiple ply handle secured at its ends respectively to the medial partition structure at each end of the carrier, medial partition panels foldably joined respectively to medial panels at each end of the carrier, and the medial partition panels being disposed in overlapping face contacting relation with each other.

3 Claims, 8 Drawing Figures

ARTICLE CARRIER

The packaging of fragile primary containers such as bottles requires maximum article separation to avoid inadvertent breakage. In order to maximize article separation, it is desirable to provide a double thickness partition element at all article contact points.

According to this invention, an article carrier is provided and comprises a bottom wall, side walls foldably joined to the side edges of the bottom wall, end wall panels foldably joined to the end edges of the side walls and extending inwardly therefrom, medial partition structure at one end of the carrier comprising a pair of medial panels foldably joined respectively to the end walls at one end of the carrier along the edges thereof remote from the side walls and extending medially inward of the carrier, medial partition structure at the other end of the carrier comprising a pair of medial panels foldably joined respectively to the end wall panels at the other end of the carrier along the edges thereof remote from the side walls and extending medially inward of the carrier, a multiple ply handle comprising at least one pair of handle panels and secured at its ends respectively to the medial partition structure at each end of the carrier, a first medial partition panel foldably joined to one of the medial panels at one end of the carrier, a second medial partition panel foldably joined to one of the medial panels at the other end of the carrier, and the inner portion of the first medial partition panel being disposed in flat face contacting relation with the inner portion of the second medial partition panel.

Figure 1:
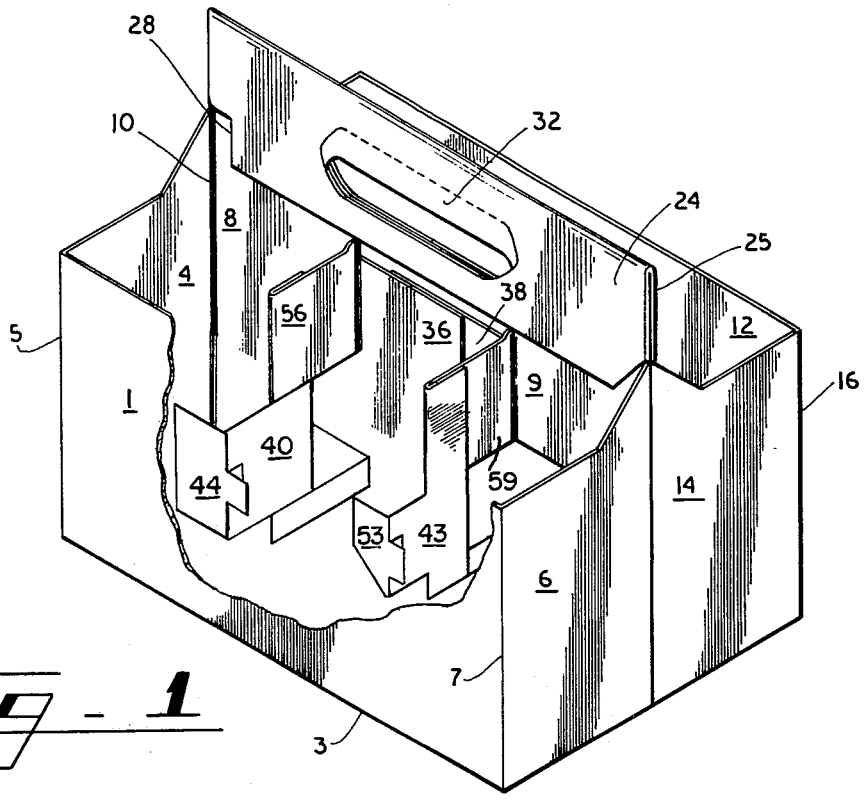
Figure 2:
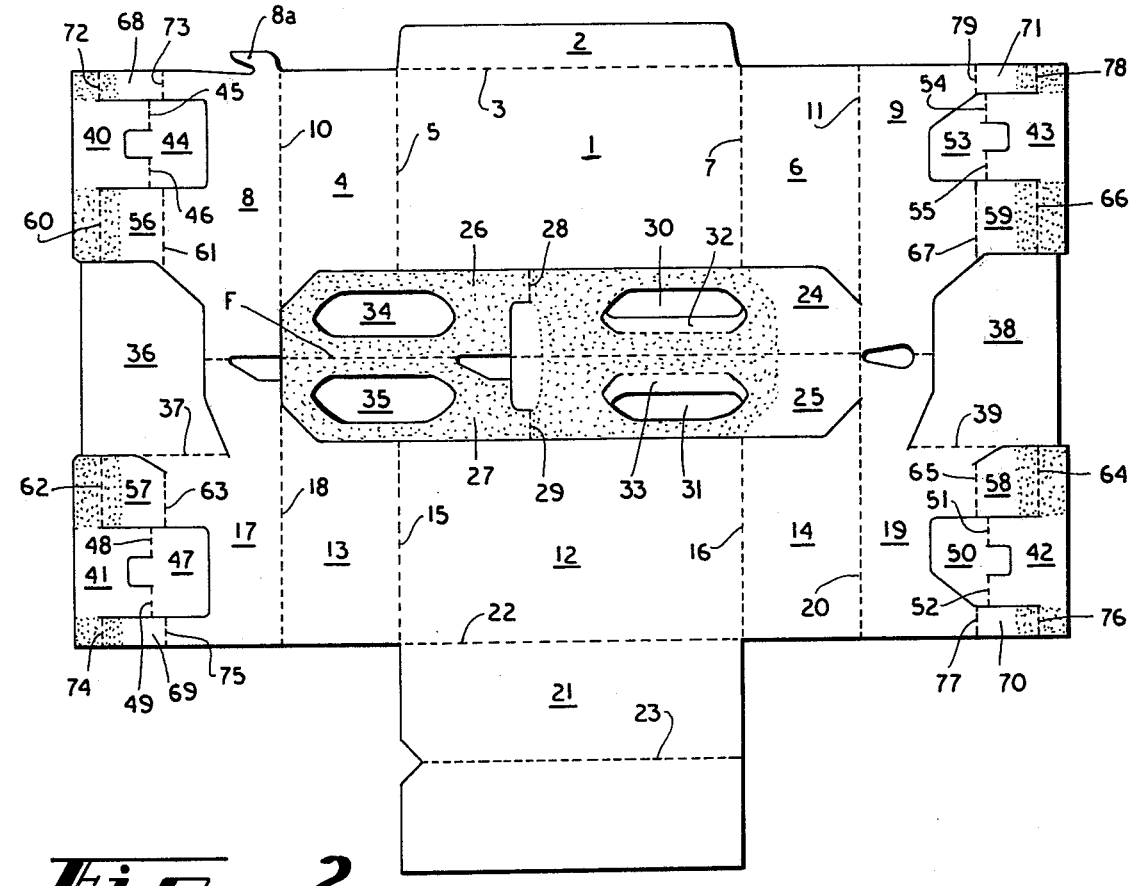
Figure 8:
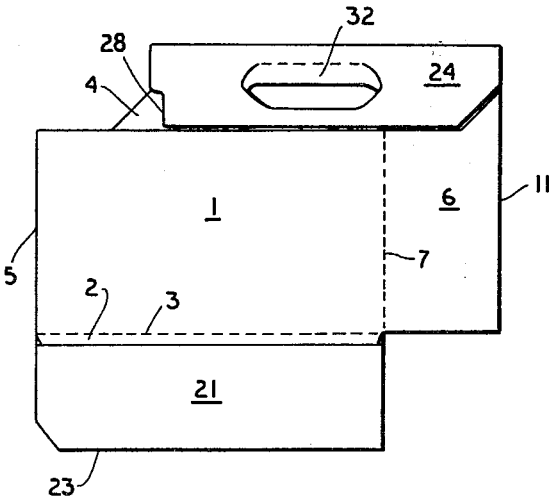

For a better understanding of the invention reference may be had to the following detailed description taken in conjunction with the accompanying drawings in which FIG. 1. is a perspective view of a set up carrier formed according to the invention with a portion thereof broken away;

FIG. 2 is a plan view of a blank from which the carrier shown in FIG. 1 is formed; and in which FIGS. 3, 4, 5, 6 and 7 depict intermediate stages through which the blank of FIG. 2 is manipulated in order to form a complete and collapsed carrier as depicted in FIG. 8.

In the drawings the numeral 1 represents a side wall of the carrier to the bottom edge of which a glue flap 2 is foldably joined along fold line 3. End wall panel 4 is foldably joined to an end edge of side wall 1 along fold line 5 while end wall panel 6 is foldably joined to the opposite end edge of side wall 1 along fold line 7. Medial panels 8 and 9 are foldably joined to end wall panels 4 and 6 respectively along fold lines 10 and 11. Medial panel 8 is provided with locking notch 8*a*.

The other side of the blank is similar to that just described and includes side wall 12 to the side edges of which end wall panels 13 and 14 are foldably joined respectively along fold lines 15 and 16. Medial panel 17 is foldably joined to end wall panel 13 along fold line 18 and medial panel 19 is foldably joined to end wall panel 14 along fold line 20. Bottom panel 21 is foldably joined to the bottom edge of side wall 12 along fold line 22 and is provided with medial fold line 23.

Handle structure for the carrier includes handle panels 24 and 25 which are foldably joined respectively to medial panels 9 and 19 along fold lines 11 and 20. In order to provide additional strength in the area of the handle, reinforcing panels 26 and 27 are provided and are joined respectively to handle panels 24 and 25 along short fold lines 28 and 29 as disclosed and claimed in U.S. Pat. No. 3,349,957 granted Oct. 31, 1967. Hand gripping apertures 30 and 31 are respectively formed in handle panels 24 and 25 and are provided with cushioning flaps 32 and 33. Similarly hand gripping apertures 34 and 35 are formed respectively in reinforcing panels 26 and 27.

To provide maximum medial article separation, medial partition structure at one end of the blank comprises medial panels 8 and 17 together with medial partition panel 36 which is foldably joined to medial panel 17 along fold line 37. Likewise at the right hand end of the blank as viewed in FIG. 2, medial partition structure comprises medial panels 9 and 19 and medial partition panel 38 which is foldably joined to medial panel 19 along fold line 39.

In order to provide individual article cells, transverse partition structure is provided and includes transverse partition panels 40, 41, 42 and 43. Anchoring tab 44 is foldably joined to transverse partition panel 40 along fold lines 45 and 46 and likewise anchoring tab 47 is foldably joined to transverse partition panel 41 along fold lines 48 and 49. In a similar configuration anchoring tab 50 is foldably joined to transverse partition panel 42 along fold lines 51 and 52 and likewise anchoring tab 53 is foldably joined to transverse partition panel 43 along fold lines 54 and 55.

In addition transverse partition panels 56, 57, 58 and 59 are provided. More specifically transverse partition panel 56 is foldably joined respectively to transverse partition panel 40 and medial panel 8 along fold lines 60 and 61. Similarly transverse partition panel 57 is foldably joined to transverse partition panel 41 and medial panel 17 respectively along fold lines 62 and 63. Transverse partition panel 58 is foldably joined to transverse partition panel 42 and medial panel 19 respectively along fold lines 64 and 65 and transverse partition panel 59 is foldably joined respectively to transverse partition panel 43 and medial panel 9 along fold lines 66 and 67.

Additional transverse article separation is provided in the form of supplementary transverse partition panels 68, 69, 70 and 71. More specifically supplementary transverse partition panel 68 is foldably joined to transverse partition panel 40 along fold line 72 and to medial panel 8 along fold line 73. In like manner supplementary transverse partition panel 69 is joined to transverse partition panel 41 along fold line 74 and to medial panel 17 along fold line 75. Supplementary transverse partition panel 70 is foldably joined respectively to transverse partition panel 42 and medial panel 19 along fold lines 76 and 77. Also supplementary transverse partition panel 71 is joined to transverse partition panel 43 along fold line 78 and to medial panel 9 along fold line 79.

Figure 3:
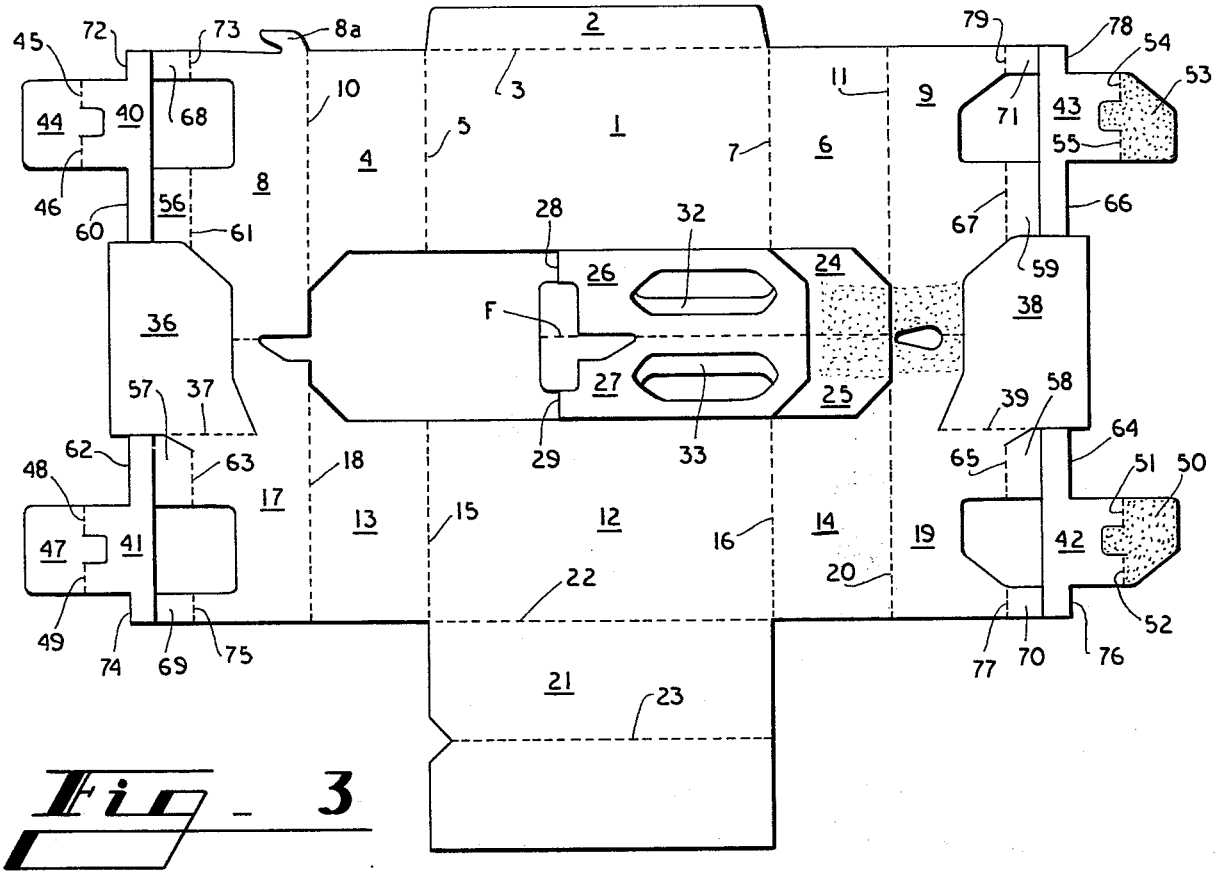

In order to form the completed carrier from the blank shown in FIG. 2, an application of glue is first made to the inner surfaces of handle panels 24 and 25 and to reinforcing panels 26 and 27 as shown by stippling in FIG. 2. Thereafter reinforcing panels 26 and 27 are elevated and folded along their respective fold lines 28 and 29 into positions of flat face contacting relation with the inner surfaces of handle panels 24 and 25 respectively. Then an application of glue is made to transverse partition panels 40, 41, 56 and 57 as well as to supplementary transverse partition panels 68 and 69 as shown by stippling in FIG. 2. Following this transverse partition panels 40 and 41 together with anchoring tabs 44 and 47 are folded downwardly out of the plane of the blank as viewed in FIG. 2 and rotated toward the left 180° along fold lines 60 and 72 and 62 and 74 respectively to occupy the positions shown in FIG. 3. The inner surfaces of transverse partition panels 40 and 41 are then adhered respectively to the inner surfaces of transverse partition panel 56 and supplementary transverse partition panel 68 and transverse partition panel 57 and supplementary transverse partition panel 69. In addition an application of glue is made to transverse partition panels 42, 43, 58 and 59 as well as supplementary transverse partition panels 70 and 71 as shown by stippling in FIG. 2. Then and generally simultaneously with the folding and gluing of transverse partition panels 40 and 41, transverse partition panels 42 and 43 and their associated anchoring tabs 50 and 53 are folded 180° toward the right and out of the plane of the blank as viewed in FIG. 2 along fold lines 64 and 76 and 66 and 78 respectively. The carrier then appears as shown in FIG. 3. Also as seen in FIG. 3, portions of anchoring tabs 44, 47, 50 and 53 are struck respectively from medial panels 8, 17, 19 and 9 and; therefore, subsequent to the various folding operations of the transverse partition structure, apertures are formed in medial panels 8, 17, 19 and 9.

Figure 4:
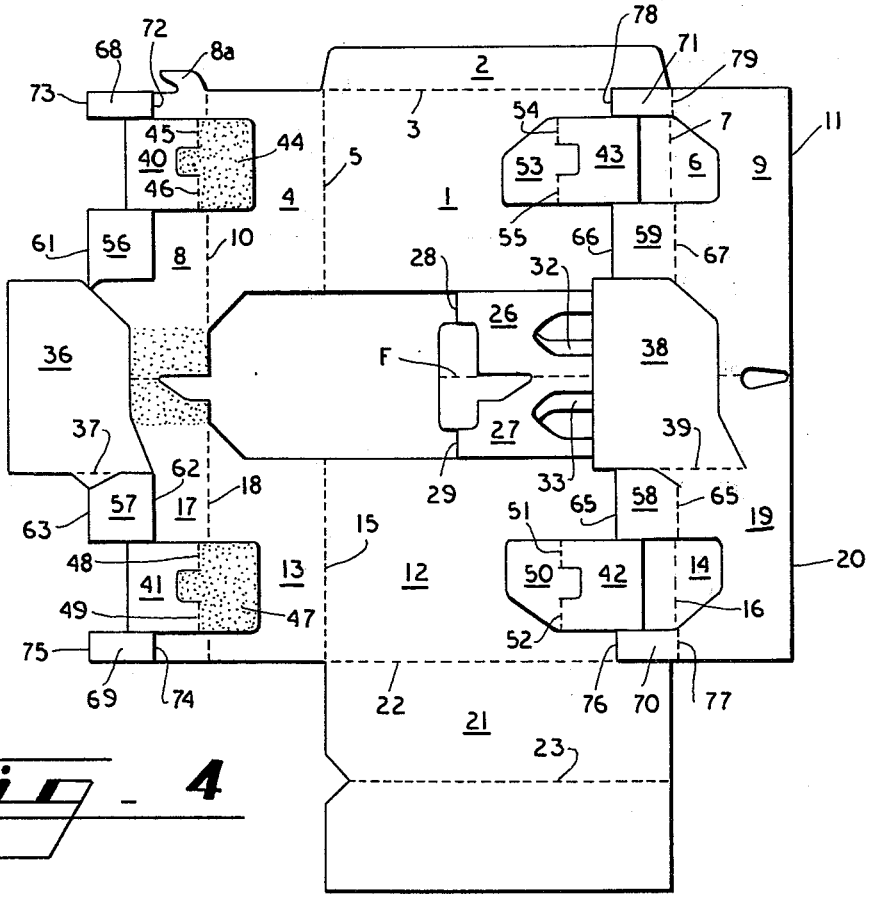

Thereafter transverse partition panel 40 together with transverse partition panel 56, supplementary transverse partition panel 68, and anchoring tab 44 are elevated and folded toward the right along fold lines 61 and 73. Likewise transverse partition panel 41, as well as transverse partition panel 57, supplementary transverse partition panel 69 and anchoring tab 47 are elevated and folded toward the right along fold lines 63 and 75. Following this an application of glue is made to anchoring tabs 50 and 53, handle panels 24 and 25, and medial panels 9 and 19 as indicated by stippling in FIG. 3. Then the transverse partition structure on the right hand side of the blank as viewed in FIG. 3 together with the medial partition structure comprising medial panels 9 and 19 and medial partition panel 38 are elevated and folded toward the left along fold lines 11 and 20. By this operation anchoring tabs 50 and 53 are adhered to the inner surfaces of side walls 12 and 1 respectively. The carrier then appears as shown in FIG. 4.

Figure 5:
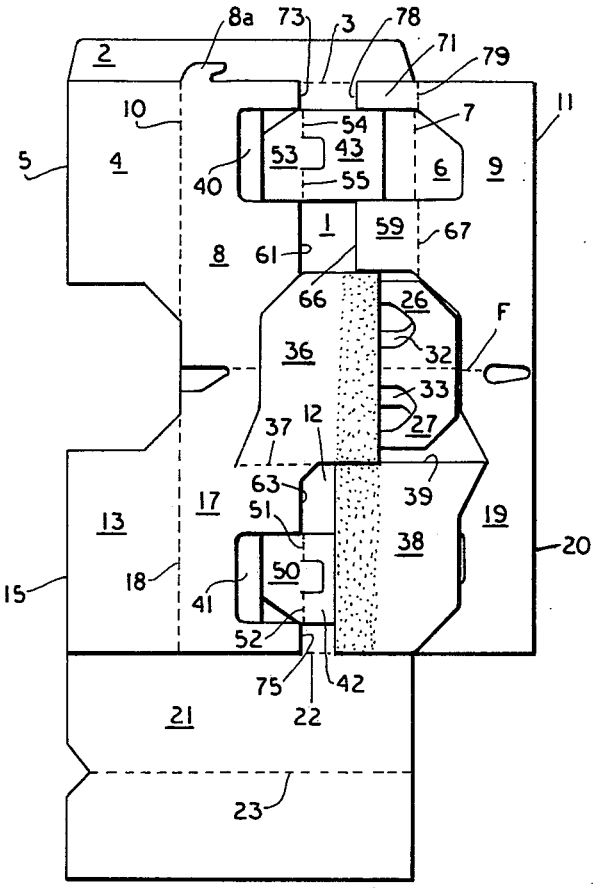

Following this medial partition panel 38 is folded up and downwardly along fold line 39 to occupy the position shown in FIG. 5. Then an application of glue is made to medial panels 8 and 17 and anchoring tabs 44 and 47 as shown by stippling in FIG. 4. Thereafter end wall panels 4 and 13, medial panels 8 and 17, medial partition panel 36 and the associated transverse partition structure on the left hand side of the blank as viewed in FIG. 4 are elevated and folded toward the right along fold lines 5 and 15 to occupy the positions shown in FIG. 5. By this operation anchoring tabs 44 and 47 are adhered to the inner surfaces of side walls 1 and 12 respectively.

Figure 6:
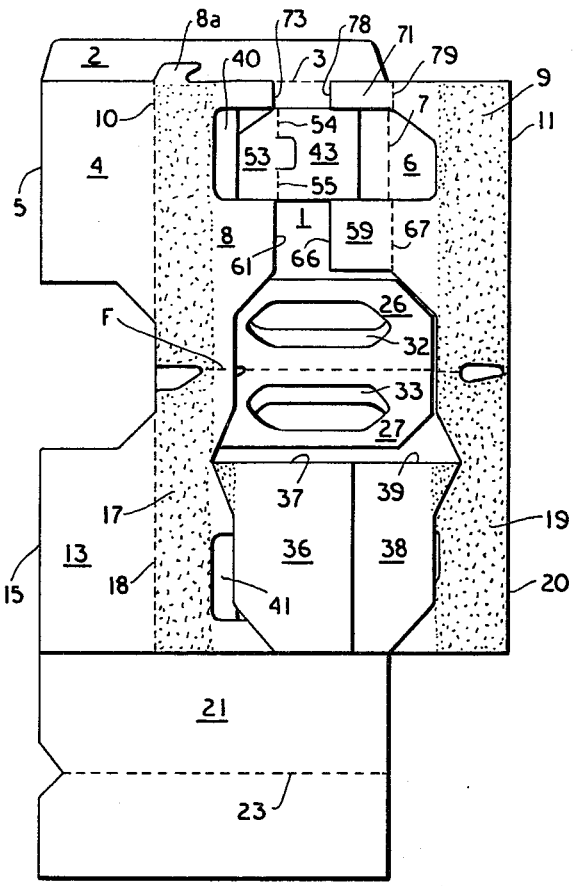
Figure 7:
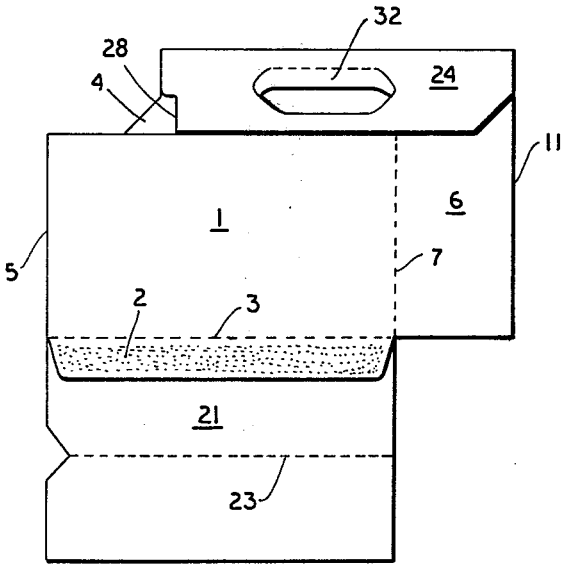

Glue is then applied to the inner edge portions of medial partition panels 36 and 38 as shown by stippling in FIG. 5 and then medial partition panel 36 is elevated and folded downwardly along fold line 37 to occupy the position shown in FIG. 6. By this operation medial partition panels 36 and 38 are adhered in overlapping face contacting relation. As best shown in FIG. 6, medial partition panels 36 and 38 provide the necessary partition structure for the apertured portions of medial panels 8, 9, 17 and 19. Therefore undesirable article contact in the area below the carrier handle is prevented.

Thereafter an application of glue is made to the carrier as shown by stippling in FIG. 6. More specifically glue is applied to medial panels 8, 9, 17 and 19, reinforcing panels 26 and 27, and medial partition panels 36 and 38. Following this the portion of the blank which is disposed above the fold line F as viewed for example in FIG. 6 is elevated and folded into the position depicted in FIG. 7. Glue is applied to glue flap 2 as shown by stippling in FIG. 7 and then bottom wall 21 is folded along fold line 23. The carrier then appears as shown in FIG. 8 which represents the completed carrier in collapsed condition.

In order to set up the carrier from its collapsed condition as shown in FIG. 8 into the condition shown in FIG. 1, it is simply necessary to secure the side walls 1 and 12 against movement toward the left and to apply a force toward the left to the medial edges of end wall panels 6 and 14. This expands the carrier and moves the side walls apart. Simultaneously the bottom wall 21 folds into a flat plane. The carrier is maintained in set up condition by cooperation between the locking notch **8*a* and one end of bottom wall 21. The carrier then appears as shown in FIG. 1.**

Therefore by this invention an article carrier is provided which has double thickness medial and transverse partitions at all article contact points. Thus maximum protection is afforded especially for fragile articles such as glass bottles.

The embodiments of the invention in which an exclusive property or privilege is claimed are defined as follows:

1. An article carrier comprising a bottom wall, side walls foldably joined to the side edges of said bottom wall, end wall panels foldably joined to the end edges of said side walls and extending inwardly therefrom, medial partition structure at one end of the carrier comprising a pair of medial panels foldably joined respectively to said end wall panels at said one end of the carrier along the edges thereof remote from said side walls and extending medially inward of the carrier, medial partition structure at the other end of the carrier comprising a pair of medial panels foldably joined respectively to said end wall panels at said other end of the carrier along the edges thereof remote from said side walls and extending medially inward of the carrier, a multiple ply handle comprising at least one pair of handle panels and secured at its ends respectively to said medial partition structure at each end of the carrier, a first medial partition panel foldably joined to one of said medial panels at said one end of the carrier, a second medial partition panel foldably joined to one of said medial panels at said other end of the carrier, the inner portion of said first medial partition panel being disposed in flat face contacting relation with the inner portion of said second medial partition panel to form a double thickness partition midway between the ends of the carrier, a pair of first transverse partition panels foldably joined respectively to a pair of said medial panels and disposed on each side of said handle, a pair of anchoring tabs secured respectively to said side walls, a pair of second transverse partition panels foldably joined respectively to said pair of anchoring tabs, the adjacent end portions of the associated pairs of said first and second transverse partition panels being foldably joined respectively to each other and being disposed in overlapping face contacting relation to form double thickness partitions midway between the side walls and handle, a portion of each of said anchoring tabs being struck from the associated one of said medial panels to form apertures therein, and portions of said medial partition panels being disposed in substantial coincidence with said apertures.

2. An article carrier according to claim 1 wherein a pair of supplementary transverse partition panels are foldably joined respectively to said pair of medial panels and wherein said pair of supplementary transverse partition panels are disposed in overlapping face contacting relation respectively with said pair of second transverse partition panels and foldably joined thereto.

3. An article carrier according to claim 1 wherein the top edges of said medial partition panels are foldably joined respectively to said medial panels along generally horizontal fold lines.

* * * * *